US008961055B2

(12) United States Patent
Corr et al.

(10) Patent No.: US 8,961,055 B2
(45) Date of Patent: Feb. 24, 2015

(54) ACTUATING LEVER FOR A BINDER MECHANISM

(71) Applicant: ACCO Brands Corporation, Lincolnshire, IL (US)

(72) Inventors: Stephen P. Corr, Gurnee, IL (US); Adam Smith, Chicago, IL (US); Michael R. Seskauskas, Lemont, IL (US); Christopher H. Cunningham, Mundelein, IL (US)

(73) Assignee: ACCO Brands Corporation, Lake Zurich, IL (US)

( * ) Notice: Subject to any disclaimer, the term of this patent is extended or adjusted under 35 U.S.C. 154(b) by 69 days.

(21) Appl. No.: 13/803,651

(22) Filed: Mar. 14, 2013

(65) Prior Publication Data

US 2013/0255433 A1 Oct. 3, 2013

Related U.S. Application Data

(60) Provisional application No. 61/618,169, filed on Mar. 30, 2012.

(51) Int. Cl.

| | |
|---|---|
| ***B42F 13/00*** | (2006.01) |
| ***B42F 3/04*** | (2006.01) |
| ***G05G 1/06*** | (2006.01) |
| ***B42F 13/26*** | (2006.01) |

(52) U.S. Cl.

CPC .. *B42F 3/04* (2013.01); *G05G 1/06* (2013.01); *B42F 13/26* (2013.01)

USPC ..... 402/38; 402/41

(58) Field of Classification Search

CPC ..... B42F 13/00

USPC ..... 402/38, 41

See application file for complete search history.

(56) References Cited

U.S. PATENT DOCUMENTS

| | | | | |
|---|---|---|---|---|
| 6,203,229 | B1 | 3/2001 | Coerver | |
| 6,280,114 | B1 * | 8/2001 | To | 402/38 |
| 6,364,558 | B1 * | 4/2002 | To | 402/38 |
| 6,474,897 | B1 * | 11/2002 | To | 402/38 |
| 6,533,486 | B1 * | 3/2003 | To | 402/38 |
| 6,536,980 | B2 * | 3/2003 | To | 402/26 |
| 7,270,496 | B2 | 9/2007 | Morgan et al. | |
| 7,491,006 | B2 * | 2/2009 | Whaley | 402/38 |
| 7,661,899 | B2 | 2/2010 | Lin | |
| 7,726,897 | B2 | 6/2010 | To et al. | |
| 8,147,160 | B2 | 4/2012 | To et al. | |
| 8,162,556 | B2 | 4/2012 | Cheng et al. | |
| 2001/0026726 | A1 * | 10/2001 | To | 402/41 |

(Continued)

OTHER PUBLICATIONS

2012 United Stationers Catalog, pp. 312 and 315, admitted prior art, all referenced binders available at least as early as Mar. 29, 2011. 251, 253 and 262, admitted prior art, all referenced binders available at least as early as Mar. 29, 2011.

Office Depot Brand View Professional Binder, 1" Rings, 220-Sheet Capacity, Burnt Orange, product details web page, retrieved from http://officedepot.com/a/products/758382/0ffice-Depot-Brand-View-Professional-Binder/, admitted prior art, referenced binder available at least as early as Mar. 29, 2011, 1 page.

(Continued)

*Primary Examiner* — Kyle Grabowski

(74) *Attorney, Agent, or Firm* — Michael Best & Friedrich LLP

(57) ABSTRACT

An actuating lever for a binding mechanism includes a body formed of a first molded material. The body defines oppositely-facing surfaces, with at least one of the surfaces having a recess formed therein. The actuating lever further includes a grip member formed of a second molded material that is different from the first molded material. The grip member is molded at least partially into the recess.

19 Claims, 3 Drawing Sheets

(56) References Cited

U.S. PATENT DOCUMENTS

| | | | | |
|---|---|---|---|---|
| 2004/0067094 | A1 | 4/2004 | Ko | |
| 2004/0234328 | A1 | 11/2004 | Wong | |
| 2006/0088365 | A1 | 4/2006 | Whaley | |
| 2009/0169287 | A1 | 7/2009 | Cheng | |
| 2010/0166490 | A1* | 7/2010 | Cheng et al. | 402/38 |
| 2011/0085846 | A1 | 4/2011 | Cheng et al. | |
| 2013/0255433 | A1 | 10/2013 | Corr et al. | |
| 2013/0287476 | A1* | 10/2013 | Huang | 402/41 |

OTHER PUBLICATIONS

2012 The Office Collection Catalog, pp. 248-

Wilson-Jones Lite-Touch No-Gap 50% Recycled Locking Round-Ring View Binder, 2" Rings, 500-Sheet Capacity, White, product details web page, retrieved from http://officedepot.com/a/products/985235/Wilson-Jones-Lite-Touch-No-Gap/, admitted prior art, referenced binder available at least as early as Mar. 29, 2011, 1 page.

* cited by examiner

ACTUATING LEVER FOR A BINDER MECHANISM

RELATED APPLICATIONS

This application claims the benefit of U.S. Provisional Patent Application No. 61/618,169, filed Mar. 30, 2012, the entire content of which is hereby incorporated by reference herein.

BACKGROUND

The present invention relates to binders of the type used for storing and organizing loose-leaf papers, and more particularly to actuating levers or triggers used for opening and closing the binder's securing mechanism.

Binders typically include a ring mechanism for releasably securing loose-leaf papers. One or more actuating levers, often called "triggers," are commonly provided on the ring mechanism for opening and closing the ring mechanism.

SUMMARY

The invention provides an improved trigger construction and manufacturing method. The trigger provides an improved grip for the user, with an enhanced, "soft" feel and a richer aesthetic that highlights the enhanced feel. It is manufactured using a co-molding process using two different materials (e.g., plastics), one harder material forming the structural body of the trigger, and a second, softer plastic material forming one or more "soft-touch" surfaces of the trigger.

In one aspect, the invention provides an actuating lever for a binding mechanism. The actuating lever includes a body formed of a first molded material. The body defines oppositely-facing surfaces, with at least one of the surfaces having a recess formed therein. The actuating lever further includes a grip member formed of a second molded material that is different from the first molded material. The grip member is molded at least partially into the recess.

In another aspect, the invention provides a method of manufacturing an actuating lever for a binding mechanism. The method includes molding a body from a first material, the molded body including oppositely-facing surfaces with at least one of the surfaces having a recess therein. The method further includes molding a grip member from a second material, which is different from the first material, directly into the recess in the body.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
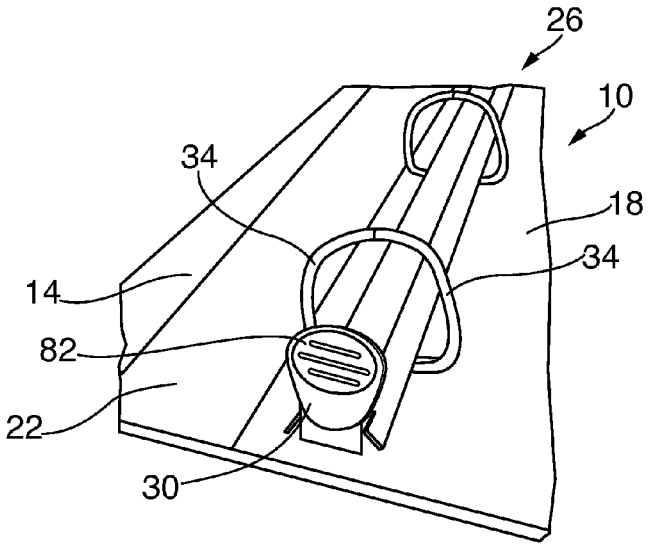
FIG. 1 is a partial perspective view of a binder including an actuating lever embodying the invention.
Figure 2A:
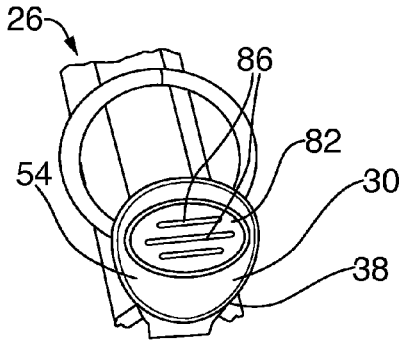
FIG. 2*a* is a partial perspective view of a binder ring mechanism showing an outside view of an actuating lever embodying the invention.
Figure 2B:
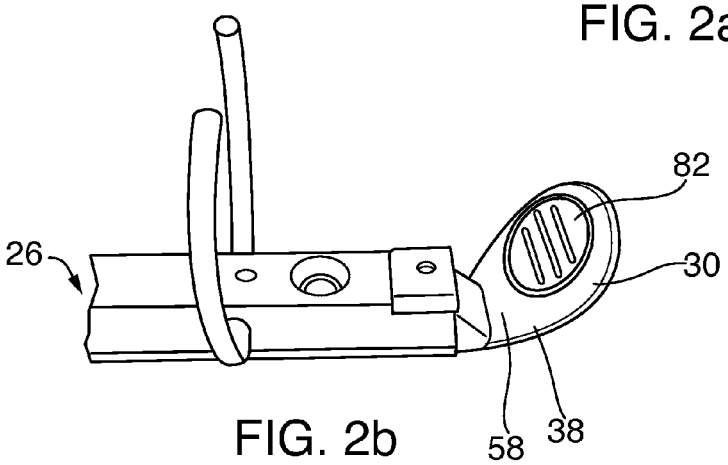
FIG. 2*b* is a partial perspective view of a binder ring mechanism showing an inside view of an actuating lever embodying the invention.

FIG. 1 illustrates a binder 10 of the type known for storing and organizing loose-leaf sheets. The binder 10 includes a front cover 14, a rear cover 18, and a spine 22. A ring mechanism 26 is coupled to the binder 10 for releasably securing loose-leaf sheets within the binder 10, as is well known. The illustrated ring mechanism 26 is a D-ring type mechanism, however, the invention is not limited to the illustrated ring mechanism 26 (see other ring mechanisms 26 in FIGS. 2*a*, 2*b*, and 3). The construction and operation of the ring mechanism 26 is understood to those of skill in the art, and will not be described in detail. The ring mechanism 26 can be opened and closed using one or more triggers or actuating levers 30 coupled to the end(s) of the ring mechanism. The actuating lever 30 is typically coupled to hinge blades within the ring mechanism 26 that pivot to open and close the ring halves 34. However, the present invention is not limited to the style or particular internal construction of the ring mechanism 26.

FIGS. 2-5 further illustrate the actuating lever 30 of the present invention. The actuating lever 30 includes a body 38 formed of a first molded material (e.g., plastic). In the illustrated embodiment, the body 38 is molded of a relatively strong, rigid plastic material, such as ABS, Nylon, Polycarbonate, or Acetal, as the body 38 defines the rigid and structural portion of the actuating lever 30 that must be able to accommodate the repeated actuation forces applied by the user to open and close the ring mechanism 26. The body 38 includes a base or connection portion 42 (see also the connection portion 42' of FIG. 4*a*) that couples to the internal mechanism of the ring mechanism 26, and a tab or actuation portion 46 to which the user applies the actuating force. In the illustrated embodiment, the tab portion 46 is configured in an inverted tear-drop shape, however, other shapes can be substituted.

Figure 3:
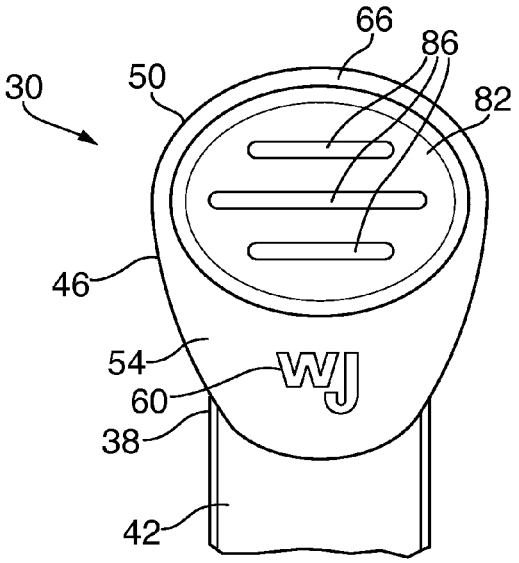
FIG. 3 is a partial front view of the actuating lever shown in FIGS. 1 and 2.
Figure 4:
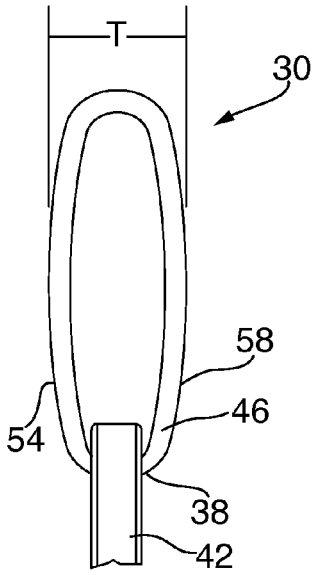
FIG. 4 is a partial side view of the actuating lever shown in FIG. 3.
Figure 5:
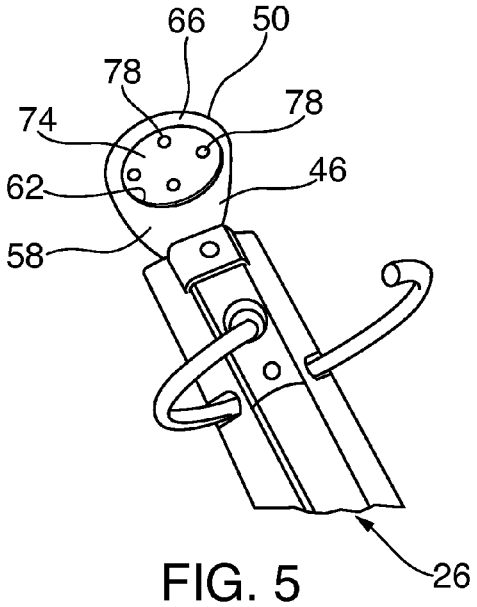
FIG. 5 is a partial perspective view of the actuating lever shown without the grip member of the second material.

Referring now to FIGS. 3, 4, and 5, the tab portion 46 of the body 38 defines an outer footprint or perimeter 50, and has oppositely-facing surfaces 54 and 58. An optional logo 60 can be printed, molded into, or otherwise applied to one or both of the oppositely-facing surfaces 54, 58. Referring now to FIG. 5, the body 38, and more specifically the tab portion 46, is molded to have a recess 62 (only one is shown in FIG. 5) formed in at least one of the oppositely-facing surfaces 54, 58. The illustrated embodiment includes two recesses 62, one formed in each of the oppositely-facing surfaces 54, 58. The second recess 62 is identical to the recess shown in FIG. 5, but is formed on the opposite side of the body 38. The recesses 62 are formed during the molding operation of the body 38. As seen in FIG. 5, the recesses 62 are formed completely within the outer perimeter 50 such that a portion of the surfaces 54, 58 define a wall or boundary 66 separating the recesses 62 from the outer perimeter 50.

A bottom surface of each of the recesses 62 is defined by a wall 74 formed by the body 38. The wall 74 includes one or more apertures 78 that extend through the wall 74 to provide communication between the recess 62 in the surface 54 and the recess 62 in the surface 58. The apertures 78 are preferably formed during the molding of the body 38, or alternatively, can be formed by drilling or other techniques after the body 38 has been formed. The purposes of these apertures 78 will be discussed further below.

The actuating lever 10 further includes one or more grip members 82 molded to the body 38. The illustrated embodiment has two grip members 82, one molded at least partially into each of the two recesses 62 to be exposed relative to both surfaces 54, 58 of the body 38. As will be described in further detail below, while the grip members 82 are described as being two grip members, in fact they are connected to one another via the apertures 78, and are formed integrally by flowing or injecting the material of the grip member 82 into one of the recesses 62 and letting it flow through the apertures 78 into the other recess 62.

The grip members 82 are formed of a second molded material (e.g., a copolymer) that is different from the first molded material used to form the body 38. In the illustrated embodiment, the grip members 82 can be made of a molded thermoplastic elastomer (TPE), thermoplastic rubber (TPR), thermoplastic polyurethane (TPU), or thermoplastic vulcanized resin (TPV) that is less rigid, much softer, and more pliable than the material used to form the body 38. The grip members 82 provide a soft, grip-like, and pliable feel for the user's thumb or finger when actuating the actuating lever 30. The grip members 82 can include texturing, such as the illustrated raised ribs 86, to further enhance the feel and grip of the grip members 82. In other embodiments, different rib configurations or different texturing can be used. In the illustrated embodiment, the grip members 82 have a different color than the body 38 to draw attention to the grip members 82, indicating to the user the intent of the grip members 82 as being the location where a finger or thumb can be positioned for applying force to the actuating lever 30. In other embodiments, the grip members 82 could be the same color as the body 38.

As best shown in FIGS. 3 and 4, the grip members are spaced from the outer perimeter 50 by the boundary 66, and therefore do not extend radially outwardly to the outer perimeter 50. Additionally, the grip members 82 are inlaid, puddled, or recessed relative to the body 38, in terms of the overall thickness of the lever 30 (i.e., in an axial direction). More specifically, the boundaries 66 defined by the surfaces 54, 58 of the tab portion 46 represent the extremes of the overall thickness dimension T (see FIG. 4) of the actuating lever 30, and the grip members 82 are recessed from the respective boundaries 66 so as not to be present at the portions of the lever 30 defining the extreme limits of the thickness dimension T. To state it another way, the grip member 82 in a given recess 62 does not extend in a direction normal to the wall 74 beyond the material of the body 38 defining the boundary 66. That is why, when viewing the lever 30 from the side (see FIG. 4), the grip members 82 cannot be seen. Such a recessed arrangement of the grip members 82 relative to the body 38, in combination with the spacing of the grip members 82 from the outer perimeter 50, offers protection to the grip members 82 from wear and abrasion that might occur due to contact with or exposure to the environment in which the binder 10 is used, stored, and transported. Because the grip member 82 does not protrude beyond the outer perimeter 50 or to the extents of the overall thickness dimension T of the body 38, automated assembly machinery can better handle the actuating levers 30. Specifically, automated assembly machinery has a more difficult time handling high coefficient of friction materials, such as the materials used for the grip member 82. Because the grip member 82 does not protrude, the machinery largely contacts only the lower coefficient of friction material of the body 38, thereby facilitating automated handling.

Figure 4A:
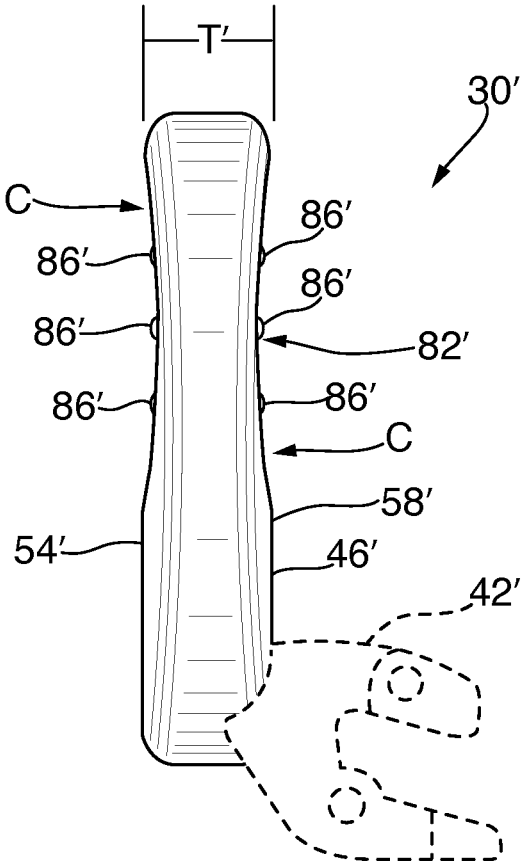
FIG. 4*a* is a partial side view of another embodiment of an actuating lever.

FIG. 4*a* illustrates another embodiment of the actuating lever 30' with an alternative side-view profile. Like components have been given like reference numerals designated as prime (').The actuating lever 30' includes oppositely-facing concave regions C formed in the body 38', and more specifically in the surfaces 54', 58' of the tab portion 46'. The concave regions C provide additional contouring to the body 38' to facilitate and make the application of finger/thumb pressure to the lever 30' more comfortable and intuitive for the user. The overall thickness dimension T' is still measured from the thickest portion of the body 38', and the grip member 82' still does not protrude to the extents of the overall thickness dimension T'. While the ribs 86' can be seen in the side view of FIG. 4*a* due to the presence of the concave regions C, they still remain within the extents of the overall thickness dimension T'.

The actuating lever 30 is made using a co-molding process (e.g., a two-shot molding process). First, the body 38 is molded by injecting the first material into a mold to form the body 38. Next, the mold cavity is adapted in preparation for molding the grip members 82. Then, the second material (i.e., the material of the grip members 82) is injected into the mold, and more specifically into one of the recesses 62. The material of the grip members 82 fills the recess 62 and also flows through the apertures 78 to fill the second recess 62. The illustrated configuration, including the wall 74 and the through-holes 78, provides for a mechanical capturing or connection between the grip members 82 and the body 38 that provides for a strong and reliable coupling of the grip members 82 to the body 38. This enables some flexibility in selecting the materials for the body 38 and the grip members 82, as materials are not necessarily limited to those that will chemically bond together. In other words, there is no requirement to use bond-grade materials commonly used in overmolding. It also eliminates the need for additional attachment devices or processes, such as separate adhesive applications or other mechanical fasteners. Furthermore, the mechanical capturing ensures that the grip members 82 will remain connected to the actuating levers 30, in contrast to other trigger designs in which a soft "cap" or "sleeve" is simply slid over a plastic or metal trigger, but can be easily removed.

Various features of the invention are set forth in the following claims.

The invention claimed is:

1. An actuating lever for a binding mechanism, the actuating lever comprising:

a body formed of a first molded material, the body defining oppositely-facing surfaces, with at least one of the surfaces having a recess formed therein; and a grip member formed of a second molded material that is different from the first molded material, the grip member being molded at least partially into the recess wherein the body includes a tab portion to which a user can apply an actuating force, the oppositely-facing surfaces being on the tab portion, and the tab portion further defining an overall thickness dimension, and wherein the grip member does not extend to the overall thickness dimension defined by the tab portion of the body.

2. The actuating lever of claim 1, wherein the first molded material is a rigid plastic, and wherein the second molded material is a pliable plastic.

3. The actuating lever of claim 2, wherein the first molded material is one of ABS, Nylon, Polycarbonate, and Acetal, and wherein the second molded material is one of thermoplastic elastomer, thermoplastic rubber, thermoplastic polyurethane, and thermoplastic vulcanized resin.

4. The actuating lever of claim 1, wherein the body includes a tab portion to which a user can apply an actuating force, the oppositely-facing surfaces being on the tab portion, and the tab portion further defining an outer perimeter, and wherein the recess is formed completely within the outer perimeter of the tab portion.

5. The actuating lever of claim 4, wherein a wall of the tab portion separates the recess from the outer perimeter such that the grip member is spaced from the outer perimeter by the wall.

6. The actuating lever of claim 5, wherein the grip member is recessed relative to the wall of the tab portion.

7. The actuating lever of claim 1, wherein both of the oppositely-facing surfaces have a recess formed therein, and wherein the grip member is molded at least partially into both of the recesses.

8. The actuating lever of claim 7, wherein the body includes a wall separating the recesses, the wall including at least one aperture therethrough providing communication between the recesses, and wherein the grip member extends through the at least one aperture.

9. The actuating lever of claim 1, wherein at least one of the oppositely-facing surfaces defines a concave region.

10. The actuating lever of claim 9, wherein both of the oppositely-facing surfaces define concave regions.

11. The actuating lever of claim 1, wherein the grip member includes texturing.

12. The actuating lever of claim 1, wherein the grip member is a different color from the body.

13. The actuating lever of claim 12, wherein there is no adhesive between the grip member and the body.

14. An actuating lever for a binding mechanism, the actuating lever comprising:

a body formed of a molded rigid plastic, the body defining oppositely-facing surfaces, with at least one of the surfaces having a recess formed therein; and a grip member formed of a molded pliable plastic that is different from the molded rigid plastic of the body, the grip member being molded at least partially into the recess;

wherein the body includes a tab portion to which a user can apply an actuating force, the oppositely-facing surfaces being on the tab portion, and the tab portion further defining an outer perimeter, and wherein the recess is formed completely within the outer perimeter of the tab portion with a wall of the tab portion separating the recess from the outer perimeter such that the entire grip member is spaced from the outer perimeter by the wall.

15. The actuating lever of claim 14, wherein the tab portion further defines an overall thickness dimension, and wherein the grip member does not extend to the overall thickness dimension defined by the tab portion of the body.

16. The actuating lever of claim 14, wherein both of the oppositely-facing surfaces have a recess formed therein, and wherein the grip member is molded at least partially into both of the recesses.

17. The actuating lever of claim 16, wherein the body includes a wall separating the recesses, the wall including at least one aperture therethrough providing communication between the recesses, and wherein the grip member extends through the at least one aperture.

18. A method of manufacturing an actuating lever for a binding mechanism, the method comprising:

molding a body from a first material, the molded body including oppositely-facing surfaces with at least one of the surfaces having a recess therein, the body further defining an outer perimeter, and wherein the recess is formed completely within the outer perimeter of the body with a wall of the body separating the recess from the outer perimeter; and molding a grip member from a second material, which is different from the first material, directly into the recess in the body such that the entire grip member is spaced from the outer perimeter by the wall.

19. The method of claim 18, wherein the molded body further defines an overall thickness dimension, and wherein the grip member is molded into the recess such that the grip member does not extend to the overall thickness dimension.

* * * * *